US005256041A

United States Patent [19]

Tucker

[11] Patent Number: 5,256,041

[45] Date of Patent: Oct. 26, 1993

[54] PERISTALTIC PUMP ARRANGEMENT

[75] Inventor: Robert D. Tucker, Memphis, Tenn.

[73] Assignee: Auto-Chlor System, Incorporated, Memphis, Tenn.

[21] Appl. No.: 14,225

[22] Filed: Feb. 5, 1993

[51] Int. Cl.[5] ..... F04B 43/08

[52] U.S. Cl. ..... 417/477

[58] Field of Search ..... 417/474–477; 604/153, 154

[56] References Cited

U.S. PATENT DOCUMENTS

| | | | |
|---|---|---|---|
| 2,018,999 | 10/1935 | De Bakey | 417/477 |
| 3,353,491 | 11/1967 | Bastian | 417/477 |
| 3,463,092 | 8/1969 | Meyer | 417/477 |
| 3,597,124 | 8/1971 | Adams | 417/477 |
| 3,876,340 | 4/1975 | Thomas | 417/475 |
| 3,990,444 | 11/1976 | Vial | 417/477 |
| 4,025,241 | 5/1977 | Clemens | 417/477 |
| 4,155,362 | 5/1979 | Jess | 417/477 |
| 4,233,001 | 11/1980 | Schmid | 417/475 |
| 4,473,342 | 9/1984 | Ilfs | 417/475 |
| 4,530,647 | 7/1985 | Uno | 417/477 A |
| 4,544,336 | 10/1985 | Faeser et al. | 604/153 |
| 4,604,038 | 8/1986 | Belew | 417/475 |
| 4,673,334 | 6/1987 | Allington et al. | 417/477 |
| 4,856,972 | 8/1989 | Benschoten et al. | 417/477 |
| 5,083,908 | 1/1992 | Gagnebin et al. | 417/477 |

*Primary Examiner*—Richard A. Bertsch
*Assistant Examiner*—Peter Korytnyk
*Attorney, Agent, or Firm*—Vorys, Sater, Seymour & Pease

[57] ABSTRACT

An improved peristaltic pumping arrangement is disclosed as comprising a housing assembly that is freely mounted on a pump drive shaft, an occludable tubing, a plurality of compression rollers being rotatable by the shaft and capable of compressing the tubing and rotatably driving the tubing and housing assembly a limited extent until the housing assembly strikes a stop assembly for arresting limited rotational movement of the housing assembly and tubing thereby allowing the imparting of sufficient torque to pump the fluid.

7 Claims, 2 Drawing Sheets

PERISTALTIC PUMP ARRANGEMENT

BACKGROUND OF THE INVENTION

The present invention is directed generally to peristaltic type pumps and, in particular, to an improved peristaltic pump arrangement for use in minimizing pump start-up problems.

Peristaltic pumps have a wide variety of applications and are often used because of their accuracy in pumping fluids, as well as their relatively inexpensive construction and assembly. Typical peristaltic pumps comprise a rotatable shaft having several circumferentially spaced tube compression rollers supported thereon which are positioned for orbital movement along a circular path against an elastically occludable tube. The tube includes a fluid inlet and an outlet and is positioned between a fixed tube reaction surface of the pump housing and the compression rollers. Peristaltic pumping is effected when the occludable tube is sequentially depressed or occluded by the compression rollers against the reaction surface. In this regard, as the drive shaft rotates, the compression rollers advance relative to the stationary tube to create peristaltic pumping action on fluid within the tube.

A disadvantage of this type of pump is the fact that the occludable tubing is necessarily elastic and will memorize depressions if the compression rollers remain static. Upon restarting there is a tendency for the pump motor driving the pump not to be able to overcome the added resistance caused by these depressions and, thus, the pump cannot operate. Moreover, there are occasional pump/motor mounting misalignment problems which occur in some installations and such variances in the desired alignment create problems in the sense that the drive shaft may encounter added rotational resistance, thereby inhibiting desired pump starting.

Various approaches have been suggested in the peristaltic pump art for addressing problems associated with the cooperation of compression rollers and the associated occludable tubing. Examples of these approaches are shown in the following U.S. Pat. Nos.: 3,353,491; 3,876,340; 3,990,444; 4,025,241; 4,233,001; and, 4,856,972.

Despite the foregoing approaches in this art there is a continuing desire to improve upon the operation of peristaltic pumps particularly in overcoming torque problems.

SUMMARY OF THE INVENTION

In accordance with the principles of the present invention, there is provided an improved peristaltic pumping apparatus comprising: a support assembly; motor means connected to the support assembly and having a drive shaft; and a pump housing assembly. Included in the pump housing assembly is means for freely mounting the pump housing assembly on the drive shaft. An occludable tubing is provided which cooperates with the pump housing assembly. The housing assembly includes a tubing support surface against which the tubing is compressed and thereby occluded. Rotatable means are provided on the shaft in the housing and include a plurality of circumferentially spaced compression rollers for selective and individual engagement with the tubing. The rollers are collectively rotated in response to rotation of the drive shaft so as to selectively compress and occlude the tubing to thereby effect peristaltic pumping of fluid through the tubing. A motion arresting means is provided which is positioned to be spaced from and engaged by the pump housing assembly after a predetermined movement of the latter. Limited movement occurs in response to rotation of the drive shaft and compression rollers driving the tubing and the housing assembly. This limited movement allows the rotatable means to gain momentum sufficient to overcome start-up torque resistance and to rotate relative to the tubing, which becomes stationary, to thereby effect peristaltic pumping of fluid through the tubing.

Among of the other objects of the present invention are the provisions of: an improved peristaltic pumping arrangement; an improved peristaltic pumping arrangement which minimizes substantially start-up torque problems caused by increased resistance of the tubing; an improved peristaltic pumping arrangement which overcomes start-up torque problems caused by misalignment of pump and drive motor; and an improved peristaltic pumping arrangement which includes a pump housing that is freely mountable on a drive motor shaft and which is rotatable until it engages stop means for limiting relative movement of the pump housing to thereby allow the pump roller means to gain momentum and thus overcome resistance of the pump roller means.

DETAILED DESCRIPTION

Figure 1:
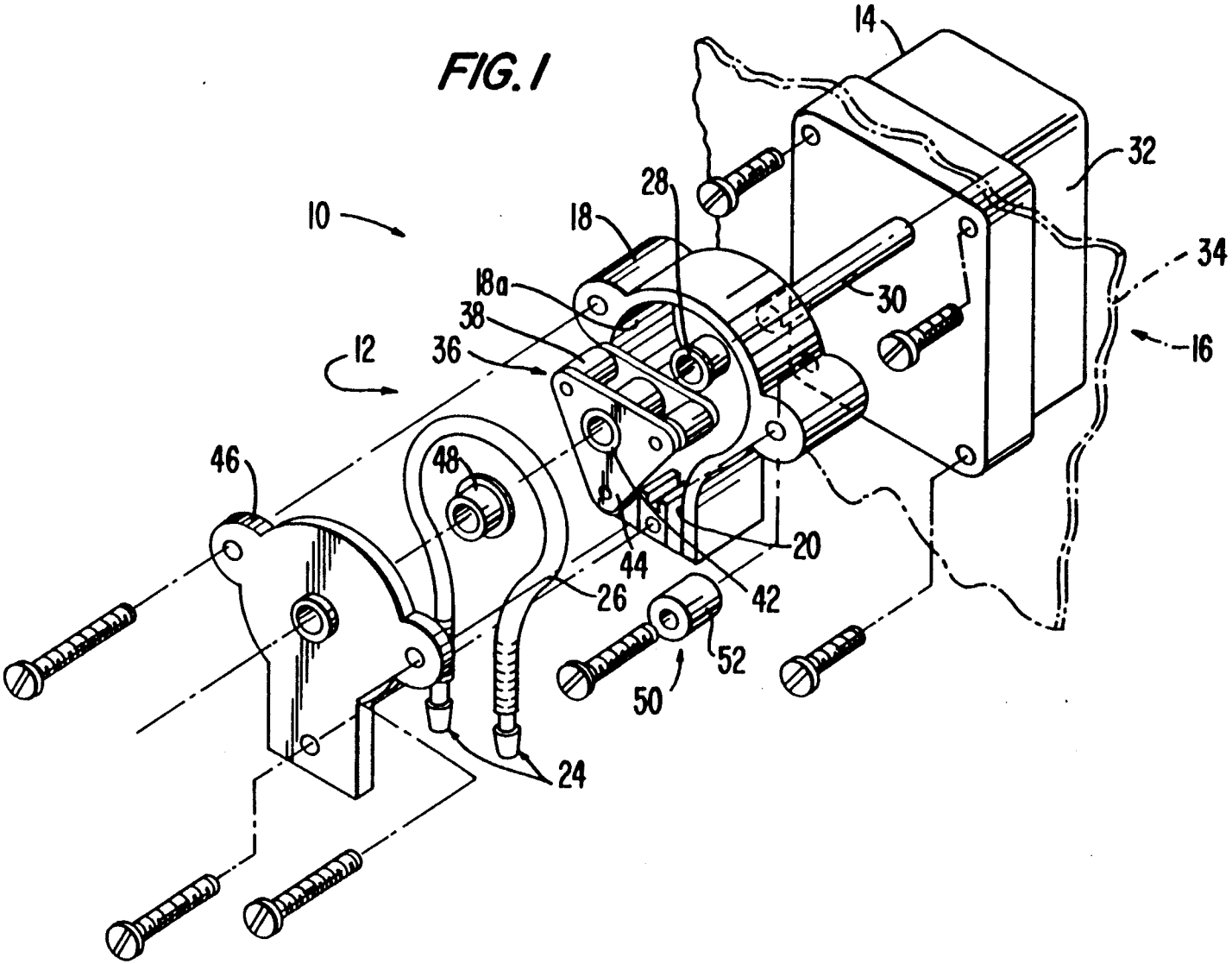
FIG. 1 is an exploded perspective view of a pumping arrangement made according to the present invention; and, FIG. 2 is an elevational view of the pump arrangement depicted in FIG. 1 with portions removed for clarity.

FIG. 1 relates to one preferred embodiment of a peristaltic pumping system 10 embodying the principles of the present invention. Included in the peristaltic pumping system 10 is a peristaltic pumping apparatus 12 a drive motor 14 therefor. Both the pumping apparatus 12 and its drive motor 14 are mounted on a suitable support assembly 16 which can, for example, be part of an operational device, such as a commercial dishwasher or the like. In this embodiment, the peristaltic pumping apparatus 12 is constructed to advance preselected quantities of liquid detergent and other chemicals as required for a washing cycle of a dishwasher.

Figure 2:
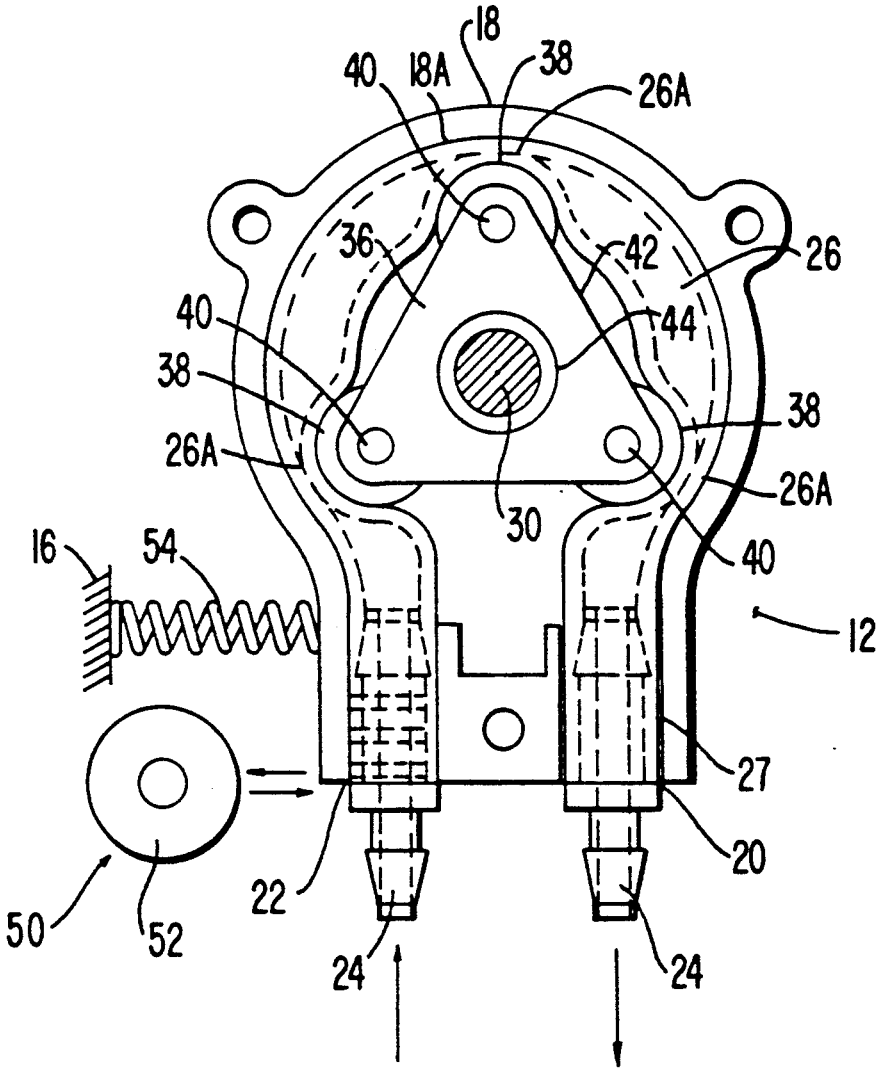

Reference is now made to FIGS. 1 and 2 for illustrating the peristaltic pumping apparatus 12 made according to one preferred embodiment of the invention. Included in the apparatus 12 is a pump casing 18 including inlet and outlet tube openings 22 and 20 for receiving fluid connectors 24 that are attached at respective inlet and outlet end portions of a flexibly, resilient squeezable or occludable tubing 26 made of a known type of material. The connector 24 and tubing 26 for the inlet opening 22 are secured to the casing 18 for movement therewith, while the connector 24 and tubing 26 for the outlet opening 20 has a slight clearance 27 therewith so as to allow relative floating movement between the tubing 26 and the casing 18, thereby minimizing undesired stretching and bending of the tubing during rotation of the casing and thus prolonging the life of such tubing.

The pump casing 18 includes a centrally located bearing 28 that is adapted to be slidably disposed on an drive shaft 30 of an electric gear type motor 32 that is secured to a suitable wall 34 of the support assembly 16. A smooth inner surface of the bearing 28 allows the casing 18 to be rotatable relative to the drive shaft 30. The casing 18 has a generally smooth and arcuate inner surface 18*a* which is adapted to define a path for the U-shaped tubing 26 as well as a reaction surface against which the tubing is selectively compressed and occluded. Also, suitably mounted on the drive shaft 30 is pump roller assembly 36 that comprises a plurality of equidistant and circumferentially spaced tubing compression rollers 38. Each of the compression rollers 38 is mounted for rotation about a shaft 40 that is secured at its opposite ends to a pair of spaced plates 42. A central drive hub 44 is secured to the plates 42 and is fixedly attached, as by a set screw, to the drive shaft 30 for positive rotation therewith. Accordingly, rotation of the shaft 30 drives the plates 42 and their compression rollers 38. In this manner the rollers 38 selectively compress the tubing so as to effect peristaltic pumping in a well-known manner.

The pumping apparatus 12 includes preferably a casing cover 46 cooperating with a central bearing 48 which has a rotatable connection to the drive shaft 30. The bearing 48 is constructed to allow the pump casing cover 46 to be freely mounted on the shaft 30 for reasons which will be explained. As a result of the foregoing relationship, the pumping apparatus 12 will rotate upon rotation of the driving shaft 30 until the casing 18 engages a stop member 50 threadedly mounted on the support assembly 16. As a result, the casing 18 and its associated tubing remain stationary and the compression rollers 38 have gained sufficient momentum to be free to rotate relative to the pump casing 18 and the tubing 26 to thereby sequentially compress and occlude the tubing against the wall 18*a*. The stop member 50 is spaced sufficiently from the casing 18 so as to allow the rollers to gain sufficient momentum. Referring back to the stop means or motion arresting means 50, it can be defined by a resilient shock absorbing sleeve 52.

Upon energization of the drive motor 32, the operation of the peristaltic pump is accomplished easily. In this regard, the motor 32 drives its shaft 30 and causes rotation of the pump roller assembly 36. Due to, for instance, resistance of the compression rollers 38 against the tubing 26, the rollers will rotate the tubing and thereby the casing 18 until the latter engages the stop member 50. By this time the rollers 38 have sufficient momentum to overcome the resistance caused by the depressions 26*a* of the tubing and to rotate relative to the stationary tubing 26 in a known manner for effecting the peristaltic pumping.

Because of the arrangement described above, start-up torque problems caused by relatively high resistance of the type created by tube depressions and/or bearing misalignment problems are overcome. Another advantage of the foregoing arrangement is that the pumping apparatus is easy to install and remove.

Another embodiment contemplates use of a compression spring or other elastomeric device 54 between the supporting assembly 16 and the casing 18 so as to tend to urge the latter into disengagement with the stop member 50 to assure starting momentum. The spring 54 functions to additionally assist in overcoming resistance.

Certain changes may be made in the above described apparatus without departing from the scope of the invention involved and it is intended that all matter contained in the description thereof or shown in the accompanying drawings shall be interpreted as illustrative and not in a limiting sense.

What is claimed is:

1. A peristaltic pumping apparatus comprising: a support assembly; motor means having a drive shaft and connected to said support assembly; a pump housing assembly including means for freely mounting said pump housing assembly thereon for rotation thereabout; an occludable tubing cooperating with said pump housing assembly; said pump housing assembly including a tubing support surface against which said tubing is compressed and occluded; rotatable means mounted on said drive shaft and including a plurality of circumferentially spaced rollers for selective engagement with said tubing and being rotational in response to rotation of said drive shaft so as to selectively compress and occlude said tubing to thereby effect pumping of fluid through said tubing; and, motion arresting means being positioned to be spaced from and engaged by said pump housing assembly after predetermined movement of said pump housing assembly means in response to rotation of said drive shaft to thereby allow said rotatable means to gain momentum sufficient to rotate relative to said tubing and thereby effect pumping of fluid through said tubing.

2. The apparatus of claim 1 further including biasing means connected to said pump housing assembly for urging said housing assembly away from said motion arresting means.

3. The apparatus of claim 2 wherein said arresting means is connected to said support means and includes an obstructing assembly which engages said pump housing assembly upon limited rotation of the latter.

4. The apparatus of claim 1 wherein said obstructing assembly includes a cushioning member thereon which is engageable by said pump housing assembly.

5. The apparatus of claim 1 wherein said means for freely mounting said pump housing assembly includes bearing means which are connected to said shaft and upon which said pump housing means is supported for freedom of rotation.

6. The apparatus of claim 5 wherein said bearing means includes a pair of spaced apart bearing means, each one of which supports opposite wall portions of said pump housing assembly.

7. The apparatus of claim 1 wherein said occludable tubing has one end portion affixed to said pump housing assembly and has another end portion assembly with freedom of movement relative to said pump housing assembly so as to minimize stretching and bending of said tubing upon movement of said housing assembly.

* * * * *